United States Patent [19]

Kikuchi et al.

[11] Patent Number: 4,649,318

[45] Date of Patent: Mar. 10, 1987

[54] ELECTRON GUN WITH LOW SPHERICAL ABERRATION

[75] Inventors: Masahiro Kikuchi; Yuzuru Kobori; Kanemitsu Murakami, all of Tokyo, Japan

[73] Assignee: Sony Corporation, Tokyo, Japan

[21] Appl. No.: 778,769

[22] Filed: Sep. 23, 1985

Related U.S. Application Data

[63] Continuation of Ser. No. 469,290, Feb. 24, 1983, abandoned.

[30] Foreign Application Priority Data

Feb. 26, 1982 [JP] Japan ..... 57-31351
Sep. 25, 1982 [JP] Japan ..... 57-167319

[51] Int. Cl.[4] ..... H01J 29/46; H01J 29/56
[52] U.S. Cl. ..... 313/449; 313/460
[58] Field of Search ..... 313/436, 448, 449, 456, 313/460, 414, 412

[56] References Cited

U.S. PATENT DOCUMENTS 2,902,623 9/1959 Knechtli ..... 313/449
3,523,205 8/1970 Oess ..... 313/456
4,052,643 10/1977 Yamazaki et al. ..... 313/449
4,178,532 12/1979 Fukuzawa et al. ..... 313/449
4,271,374 6/1981 Kimura ..... 313/449

FOREIGN PATENT DOCUMENTS 260617 8/1964 Australia ..... 313/436

*Primary Examiner*—David K. Moore
*Assistant Examiner*—K. Wieder
*Attorney, Agent, or Firm*—Hill, Van Santen, Steadman & Simpson

[57] ABSTRACT

An electron gun of uni-potential type is disclosed, which includes a main electron lens system consisting of a front electron lens system formed of a third grid and a fourth grid and a rear electron lens system formed of the fourth grid and a fifth grid of which the electron lens action regions are separated from each other. In this case, the electron lens diameter of the front electron lens system is selected smaller than that of the rear electron lens system, and the aperture diameter of the fifth grid in the rear electron lens system is selected larger than that of the fourth grid, and may be nearly as large as the inner diameter of the tube in which it is placed for use.

5 Claims, 11 Drawing Figures

ELECTRON GUN WITH LOW SPHERICAL ABERRATION

This is a continuation of application Ser. No. 469,290, filed 2/24/83 now abandoned.

BACKGROUND OF THE INVENTION

1. Field of the Invention

This invention relates generally to electron guns and particularly is directed to an electron gun of uni-potential type with low spherical aberration.

2. Description of the Prior Art

Because an electron gun of uni-potential type has good blooming characteristic in the high electric current range, it is utilized in such devices as color picture tubes or projector tubes. In general, the electron gun of uni-potential type comprises a cathode K, a first grid (control electrode) $G_1$, a second grid (acceleration electrode) $G_2$ a third grid (first anode electrode)$G_3$, a fourth grid (focusing electrode ) $G_4$, and a fifth grid (second anode electrode) $G_5$ arranged in this order. In this electron gun, in order that an electron beam may impinge with a smaller spot diameter on a phosphor screen surface, it is important to reduce as much as possible the spherical aberration of an electron lens, particularly a main electron lens formed of the third grid $G_3$, the fourth grid $G_4$ and the fifth grid $G_5$. To this end it is required that an aperture diameter of each grid in the main electron lens system is made large. However, in order to make the grid aperture diameter large, it is necessary that the cathode ray tube envelope in which the electron gun is incorporated to have a neck portion of large inner diameter. However, the provision of a larger inner diameter of the neck portion lowers the deflection sensitivity of a deflection yoke.

On the other hand, as shown in FIG. 1, when the unipotential lens consists of a decelerating lens Lens 1 formed of the third and fourth grids $G_3$ and $G_4$, and an accelerating lens Lens 2 formed of the fourth and fifth grids $G_4$ and $G_5$, its electron lens action region can be separated, so that the aberration coefficient of the main electron lens system can be considered as being separated into the decelerating lens Lens 1 side and the accelerating lens Lens 2 side. Since the aberration coefficient is small in the decelerating lens and large in the accelerating lens, if the aberration amount of the accelerating lens is improved to have a further weaker lens action, the whole aberration amount of the uni-potential lens can be improved.

FIG. 2 shows an electron gun with low aberration coefficient we have previously proposed as a Japanese patent application No. 15581/1977 (no corresponding U.S. patent application), on the basis of the fact that the aforesaid aberration coefficient of the main electron lens system can be separated into the decelerating lens side and the accelerating lens side. This previously proposed electron gun comprises a cathode K, a first grid $G_1$, a second grid $G_2$, a third grid $G_3$, a fourth grid $G_4$ and a fifth grid $G_5$ arranged sequentially in which an anode voltage $V_A$ is applied to the third and fifth grids $G_3$ and $G_5$ and a focusing voltage $V_F$ is applied to the fourth grid $G_4$ permitting the third grid $G_3$ to constitute a main electron lens system of unipotential type. In this electron gun, an electron lens diameter $D_1$ of the front decelerating lens (Lens 1) forming the main electron lens system (namely, an aperture diameter of each opposing end of the third and fourth grids $G_3$ and $G_4$) is selected smaller than an electron lens diameter $D_2$ of its rear accelerating lens (Lens 2) namely, an aperture diameter of each opposing end of the fourth and fifth grids $G_4$ and $G_5$) or to satisfy $D_2 > D_1$, and the fourth grid $G_4$ is made to have a length $l=(l_1+l_2)$ so as to be capable of separating the electron lens action region into those of the front and rear lenses Lens 1 and Lens 2 whereby the aberration coefficient of the main electron lens system can be made small. In the art, each of the grids $G_1$ to grid $G_5$ is held by a common insulation holding rod (so-called glass beads). Consequently, when the electron gun with the grids held together by the insulation holding rod is incorporated into the neck portion of the cathode ray tube envelope, the need for the space of the insulation holding rod restricts the diameter of an aperture of grid. When the electron gun is incorporated into the neck portion of, for example, 29 mm in inner diameter, the effective inner diameter of the grid is about 14 mm at best. In view of such aspect, we have previously proposed the electron gun shown in FIG. 2 capable of reducing the aberration coefficient by making the diameter of the declerating lens (Lens 1) small.

OBJECTS AND SUMMARY OF THE INVENTION

Accordingly, an object of this invention is to provide an electron gun of unipotential type capable of removing the afore-said defects.

Another object of this invention is to provide an electron gun of uni-potential type capable of reducing as much as possible a spherical aberration of a main electron lens system electron gun of uni-potential type suitable for use with a color picture tube or a projector tube and so on.

In accordance with an aspect of the present invention, there is provided an electron gun comprising a main electron lens system which consists of a front electron lens system formed of a third grid and a fourth grid and a rear electron lens system formed of said fourth grid and a fifth grid of which the electron lens action regions are separated from each other, in which an electron lens diameter of said front electron lens system is selected smaller than that of said rear electron lens system, and an aperture diameter of said fifth grid in said rear electron lens system is selected larger than that of said fourth grid.

Other objects, features and advantages of the present invention will become apparent from the following description taken in conjunction with the accompanying drawings through which the like references designate the same elements and parts.

BRIEF DESCRIPTION OF THE DRAWINGS

FIG. 7 is a graph used to explain how an equation of aberration coefficient is searched for;

DESCRIPTION OF THE PREFERRED EMBODIMENTS

Hereinafter, an electron gun of unipotential type according to this invention will be described with reference to the attached drawings.

Figure 3:
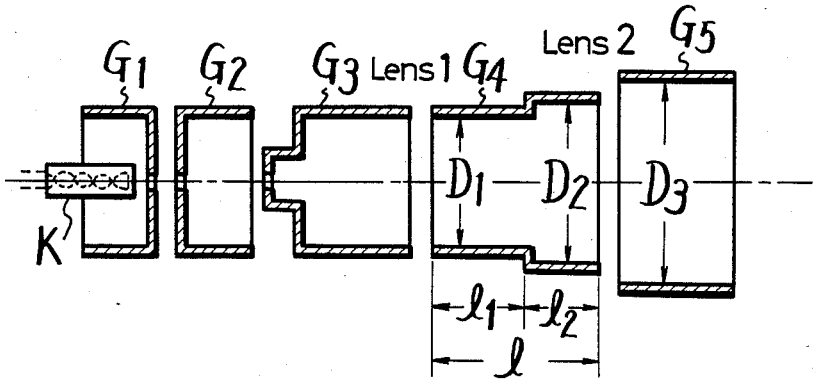
FIG. 3 is a cross-sectional view illustrating a fundamental example of an electron gun according to this invention.

FIG. 3 shows a fundamental example of an electron gun of unipotential type according to this invention which comprises in turn a cathode K and a first grid $G_1$ to a fifth grid $G_5$. In this example, a high voltage of, for example, anode voltage $V_A$ is applied to the third and fifth grids $G_3$ and $G_5$ and a focusing voltage $V_F$ much lower than the anode voltage $V_A$ is applied to the fourth grid $G_4$ permitting the third grid $G_3$ to the fifth grid $G_5$ to constitute a main electron lens system of unipotential type. Also in accordance with this invention, the third grid $G_3$ and the fourth grid $G_4$ constitute a front decelerating electron lens (Lens 1), while the fourth grid $G_4$ and the fifth grid $G_5$ constitute a rear accelerating electron lens (Lens 2). Particularly in accordance with the present invention, the fourth grid $G_4$ is made to have its length l so as to separate the electron lens action regions of the front electron lens (Lens 1) and the rear electron lens (Lens 2) the front electron lens (Lens 1) is constituted to have its electron lens diameter smaller than that of the rear electron lens (Lens 2), and the fifth grid $G_5$ in the rear electron lens (lens 2) is constituted to have the aperture diameter larger than that of the fourth grid $G_4$. In other words, the fourth grid $G_4$ has at its side facing the third grid $G_3$ an aperture diameter $D_1$ and at the other side facing the fifth grid $G_5$ an aperture diameter $D_2$ larger than $D_1$, and the fifth grid $G_5$ is constituted to have its aperture $D_3$ larger than the above aperture $D_2$. Above-mentioned relationship is represented by an inequality $D_1<D_2<D_3$. Furthermore, in order to separate the electron lens action regions of the front electron lens (Lens 1) and the rear electron lens (Lens 2), the fourth grid $G_4$ is constituted to have its length $l=(l_1+l_2)$ larger than 1.5 times the aperture diameter of the third grid $G_3$ and accordingly the smaller aperture diameter $D_1$ of the fourth grid $G_4$; that is, $l \geqq 1.5\ D_1$.

According to the arrangement so far described, the aberration amount of the rear accelerating electron lens (Lens 2) is improved, giving rise to more improvement of the whole aberration of the electron lens system.

Figure 5:
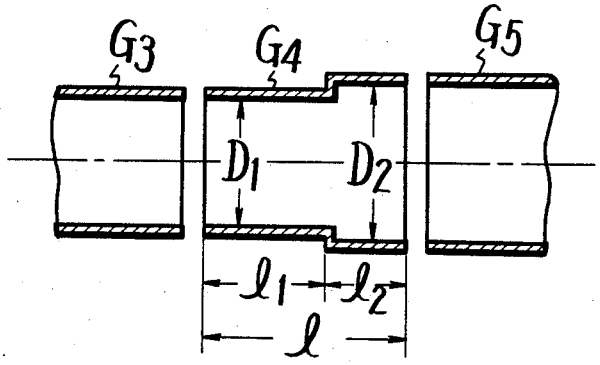
FIG. 5 (PRIOR ART)
Figure 6:
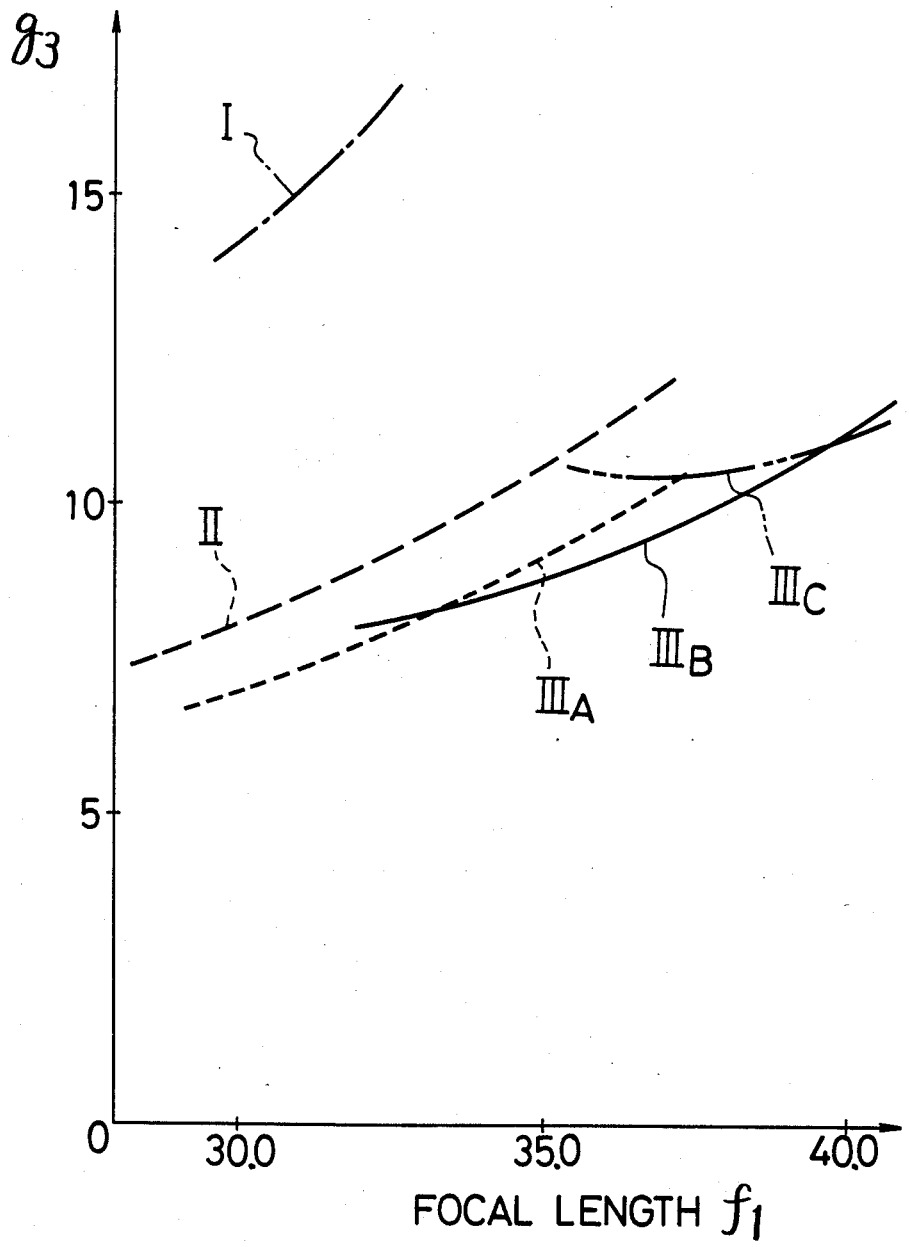
FIG. 6 is a graph concerning a spherical aberration coefficient and a focal length of the electron gun according to this invention and the conventional electron gun.

FIG. 6 is a graph indicating compared results of the spherical aberration coefficient between the electron gun of this invention and a conventional electron gun. In this graph of FIG. 6, the ordinate indicates an amount $g_3$ relating to the spherical aberration coefficient, (which will be represented in the following equation of aberration coefficient) while the abscissa indicates a focal distance $f_1$ at the side of an object (crossover point) side. In this graph, a curve I represents a case of an electron gun of ordinary unipotential type shown in FIG. 4 having the respective aperture diameter of the third grid $G_3$, the fourth grid $G_4$ and the fifth grid $G_5$ the same and the length l of the fourth grid G, as 21.0 mm. A curve II represents a case of an electron gun of unipotential type shown in FIG. 5 in which the diameter $D_2$ of the rear electron lens (Lens 2) and the aperture diameter of the fifth grid $G_5$ is the same as that of the fourth grid $G_4$ at its side facing to the fifth grid $G_5$ and is selected larger than the diameter $D_1$ of the front electron lens (Lens 1), with $D_1=13.8$ mm, $D_2=16.4$ mm, $l=28.1$ mm, $l_2=10$ mm. Curves IIIA, IIIB and IIIC represent cases of the electron gun of unipotential type shown in FIG. 3 according to this invention with $l=28.1$ mm, 33.1 mm and 38.1 mm, respectively, where $D_1=13.8$ mm, $D_2=16.4$ mm, $D_3=22.0$ mm and $l_2=10$ mm are common.

Figure 1:
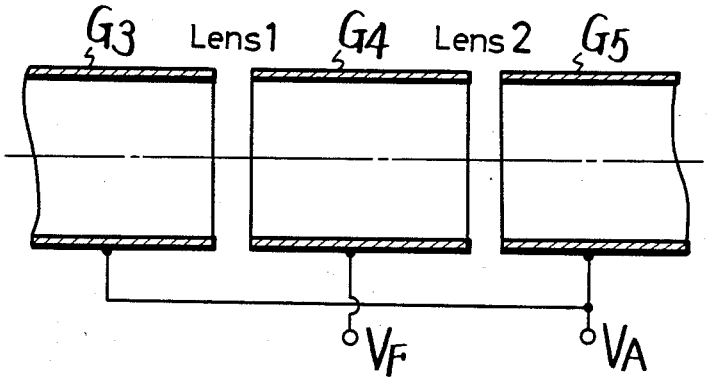
FIG. 1 is a cross-sectional view of a main electron lens of an electron gun used to explain this invention.
Figure 2:
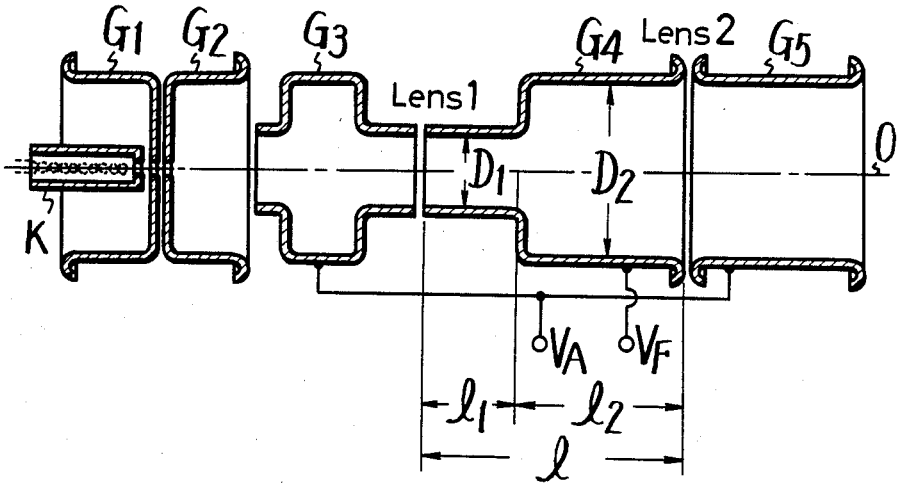
FIG. 2 (PRIOR ART)
FIG. 2 is a cross-sectional view illustrating an example of a conventional electron gun of unipotential type.
Figure 7:
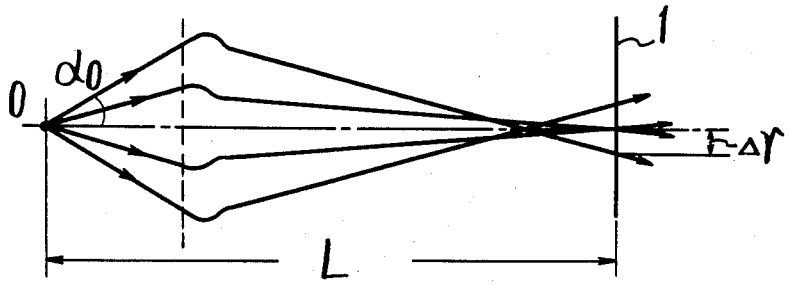

The equation relating to the aberration coefficient will be represented with reference to FIG. 7. If the spherical aberration coefficient is taken as $C_S$, the magnification of lens as M, and a half-angle of maximum divergent angle of the electron beam from the crossover point (object point) O as $\alpha_o$, the aberration amount $\Delta r$ (the radius of beam spot impinged on an image plane 1) is given as: $\Delta_r=MC_S\alpha_o^3$ $$C_S = C_{S0} + \frac{C_{S1}}{M} + \frac{C_{S2}}{M_4} + \frac{C_{S3}}{M_4} + \frac{C_{S4}}{M_4}$$

The amount $g_3$ in FIG. 6 indicates an amount expressed by:

$$g_3 \simeq C_{SO}/f_2$$

$$\Delta_r \simeq (L_{a0}^3)\ g_3$$

where $f_2$ represents the focal distance of the image side and L represents the distance from the object point to the image plane.

As is clear from FIG. 6, the electron gun according to this invention can offer an aberration coefficient better than that of the conventional electron gun shown in FIG. 5, resulting in a reduction of the aberration coefficient in an amount of 15 to 20%. Moreover, our work reveals that the aberration amount was not substantially increased even when the fourth grid $G_4$ is inserted into the fifth grid $G_5$ in overlapped state.

A practical embodiment of this invention will now be described.

Figure 8:
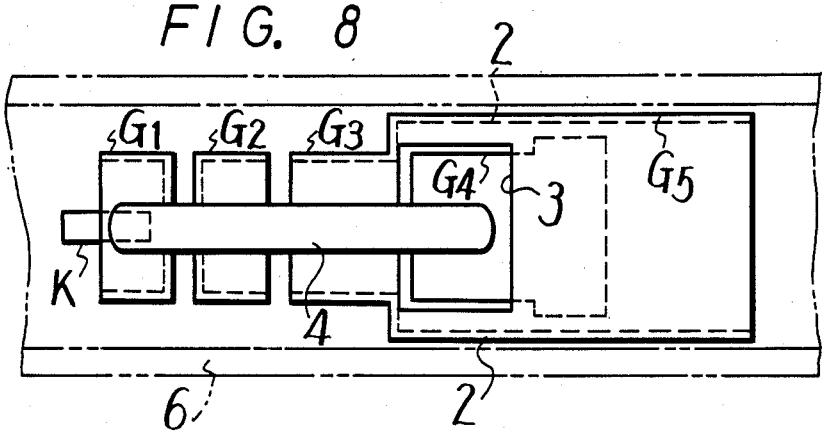
FIGS. 8 and 9 are a plan view and a cross-sectional view illustrating an embodiment of electron gun according to this invention.
Figure 9:
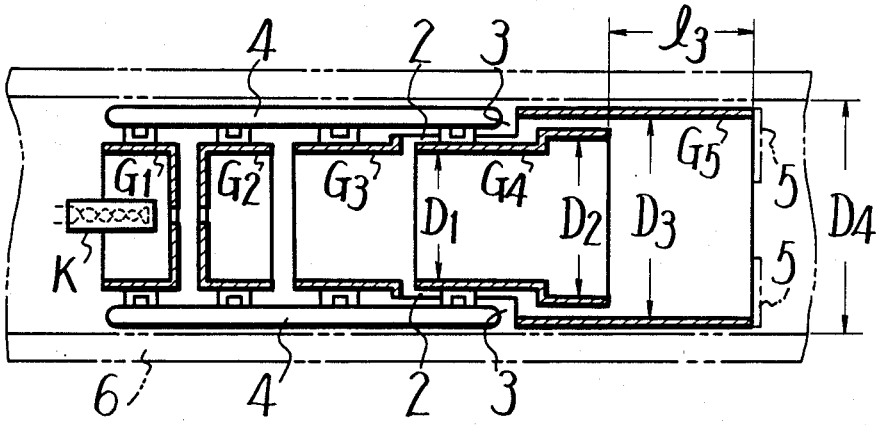

FIGS. 8 and 9 illustrate a practical embodiment of the electron gun according to this invention, which comprises a cathode K and a first grid $G_1$ to a fifth grid $G_5$, each arranged in turn along the common axis. In this example, especially the fifth grid $G_5$ with the aperture diameter $D_3$ and the third grid $G_3$ with the aperture diameter $D_1$ are formed into a unitary structure and the fourth grid $G_4$ is placed within the fifth grid $G_5$ formed into the unitary structure. In this case, in an elongated portion 2 extending from the long fifth grid $G_5$ with opposed windows 3 and connected with the third grid $G_3$, so that the elongated portion 2 substantially corresponds to a lead portion by which the fifth grid $G_5$ is electrically connected with the third grid $G_3$. The fourth grid $G_4$ with a small aperture portion of diameter $D_1$ and a large aperture portion of diameter $D_2$ is inserted into the long fifth grid $G_5$ at its large aperture diameter portion and facing to the third grid $G_3$ at its small aperture diameter portion at the window portions 3. The small aperture diameter portion of this fourth grid $G_4$ and the third grid $G_3$ constitute a front electron lens system (lens 1), while the large aperture diameter portion of the fourth grid $G_4$ and the fifth grid $G_5$ constitute a rear electron lens system (lens 2). Under this state, the first grid $G_1$ to the fourth grid $G_4$ are held together by common insulation holding rods 4. In this case, especially the fourth grid $G_4$ is held at the window portions 3. Since at the forward end portion of the fifth grid $G_5$ there is provided a shield plate 5 for getter-shielding, a distance $l_3$ between the forward end of the fourth grid $G_4$ and the shield plate 5 is selected to be such a distance to prevent the electron lens from being formed between the fourth grid $G_4$ and the shield plates 5; for example, a distance satisfying $l_3/D_3 \geqq 0.57$. The electron gun thus arranged is placed into a neck portion 6 of a cathode ray tube envelope. In this case, if the inner diameter of the neck portion 6 is taken as $D_4$, the aperture diameter $D_3$ of the fifth grid $G_5$ can be selected so as to satisfy $D_4 > D_3 > 0.65\ D_4$.

In this way, according to the present invention, as shown in FIGS. 8 and 9, the fifth grid $G_5$, and the third grid $G_3$, are mechanically formed into a unitary body, the fifth grid $G_5$ is not held directly by the insulation holding rods 4, but held at the same time when the third grid $G_3$ is held by the insulation holding rods 4; and the fourth grid $G_4$ is held by the straight insulation holding rods 4 through the window portions 3 formed in the elongated portion 2 of the fifth grid $G_5$ at the same time when the third, second and first grids $G_3$, $G_2$ and $G_1$, are all held. Thus, the distance between the opposing insulation holding rods 4 at their outside surfaces can be made smaller than the aperture diameter $D_3$ of the fifth grid $G_5$ so that the aperture diameter $D_3$ of the fifth grid $G_5$ can be increased until it approximates the inner diameter $D_4$ of the tube neck portion 6, and further the spherical aberration of the main electron lens system can be reduced.

Figure 10:
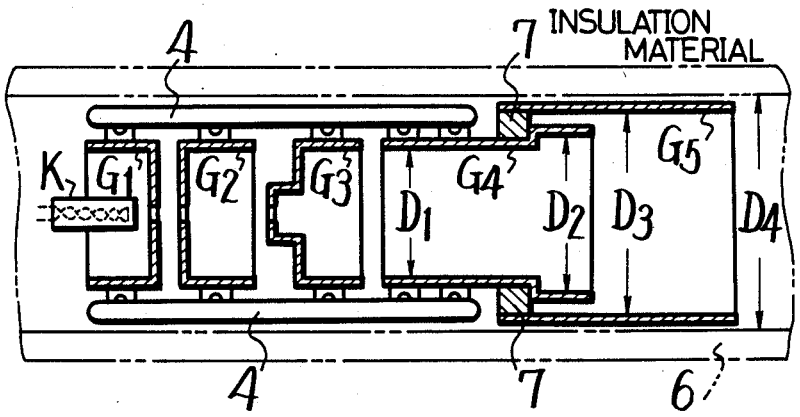
FIG. 10 is a cross-sectional view of another embodiment of the electron gun according to this invention.

FIG. 10 shows another embodiment of this invention. In this embodiment, the third grid $G_3$, the fourth grid $G_4$ and the fifth grid $G_5$ are formed separate, and under the condition that the fourth grid $G_4$ is inserted at its large aperture portion into the fifth grid $G_5$, the fourth grid $G_4$ and the fifth grid $G_5$ are mechanically connected by an annular ceramic insulation material 7 via solder material. Then, the first grid $G_1$ to the fourth grid $G_4$ are held together by the same insulation holding rods 4 and the third grid $G_3$ and the fifth grid $G_5$ are connected to each other by proper lead wires, not shown, a desired electron gun being thereby constructed.

According to the electron guns of the invention shown in FIGS. 8 to 10, since the fifth grid $G_5$ is mechanically coupled with the third grid $G_3$ or the fourth grid $G_4$ to comprise a unitary body, which is not held by and between the insulation holding rods 4, the aperture diameter $D_3$ of the fifth grid $G_5$ can be increased to approximate the inner diameter $D_4$, of the neck portion 6. Thus in the rear electron lens system (Lens 2) the aperture diameter $D_3$ of the fifth grid $G_5$ can be made larger than the aperture diameter $D_2$ of the fourth grid $G_4$, and without increasing the inner diameter $D_4$ of the neck portion 6, the spherical aberration of the main electron lens system can be reduced.

Figure 4:
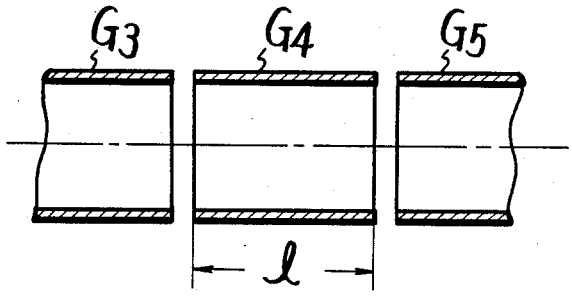
FIG. 4 (PRIOR ART)
FIGS. 4 and 5 are respectively cross-sectional views of main parts of the prior art electron guns.
Figure 11:
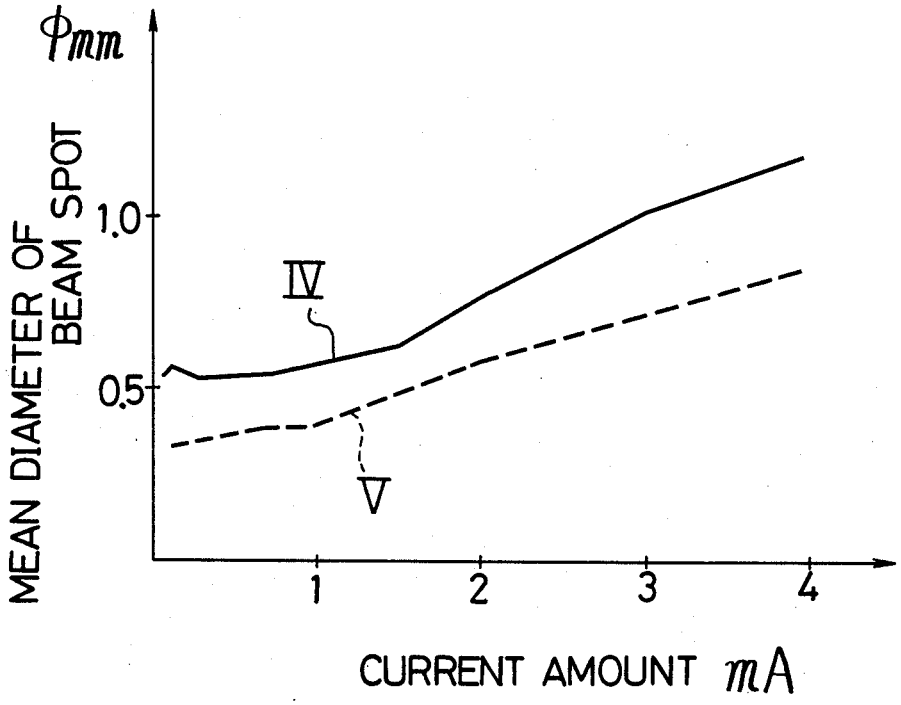
FIG. 11 is a graph showing a relation between a current amount and a diameter of a beam spot with respect to the electron gun of this invention and the conventional electron gun.

FIG. 11 is a graph showing a relationship between a current amount (mA) and a mean diameter (mm) of a beam spot on the phosphor screen with respect to the aforesaid electron gun of this invention and the conventional electron gun of unipotential type of FIG. 4. In this graph of FIG. 11, curve IV indicates the relationship of the conventional electron gun and curve V that of the present invention. As will be apparent from FIG. 11, according to this invention, the beam spot is significantly improved.

Furthermore, it is also possible that the rear electron lens (lens 2) is formed as an extended-field type lens with the inner diameter of the end electrode large. Such a modified electron gun can also reduce the spherical aberration.

As described above, the electron gun according to this invention can provide a more reduced, or improved, spherical aberration than the conventional electron gun. By selecting the electron lens aperture of its front electron lens system smaller than that of the rear electron lens system, each electron lens action region being separated, so that the electron gun of this invention is suitable for use with a color picture tube, a projector tube and so on. The above describes preferred embodiments of the invention, but it will be apparent that many modifications and variations can be effected by one skilled in the art without departing from the spirit or scope of the novel concepts of the invention, so that the scope of the invention should be determined by the appended claims only.

We claim as our invention:

1. A unipotential type electron gun comprising a main electron lens system having a first electron lens system and a second electron lens system of which the electron lens operative regions are separated from each other, said first system being formed of a third grid and a fourth grid, said second system being formed of said fourth grid and a fifth grid, the aperture diameter of aid fifth grid being larger than that of said fourth grid, and the aperture diameter of said fourth grid facing said fifth grid being larger than that of said fourth grid facing said third grid, wherein said third grid and said fifth grid are mechanically and electrically united into an unitary structure, wherein at least one window portion is formed in said unitary structure, and wherein said fourth grid is arranged within said unitary structure and wherein said fourth grid is held by means of at least one insulating holder through said window portion, which holder also holds first, second and said third grids and a shield plate attached to the front end of said fifth grid and $l_3/D_3 \geqq 0.57$ where $D_3$ is the diameter of the fifth grid and $l_3$ is the distance from said shield plate to the front edge of said fourth grid.

2. An electron gun according to claim 1, in which said fourth grid is held by means of opposing insulating holders.

3. An electron gun according to claim 1, in which said insulating holders are glass beads.

4. An electron gun according to claim 2 wherein said fifth grid is larger in diameter than the distance between said opposing insulating holders.

5. An electron gun according to claim 1 wherein said electron gun is mounted into the neck portion of a glass envelope which has an inside diameter $D_4$ and $D_4 > D_3 > 0.65\ D_4$ where $D_3$ is the aperture diameter of said fifth grid.

* * * * *